US007461448B2

(12) United States Patent
Schwartzman et al.

(10) Patent No.: US 7,461,448 B2
(45) Date of Patent: Dec. 9, 2008

(54) CRIMPING TOOL WITH QUICK-CHANGE CRIMP HEAD FOR SEALING AND ELECTRICALLY CRIMPING ELECTRICAL CONTACTS TO INSULATED WIRE

(76) Inventors: Simon Schwartzman, 1205 S. Catalina Ave. #D, Redondo Beach, CA (US) 90277; Alex Kerner, 16887 Avenida de Santa Ynez, Pacific Palesads, CA (US) 90272

( * ) Notice: Subject to any disclaimer, the term of this patent is extended or adjusted under 35 U.S.C. 154(b) by 511 days.

(21) Appl. No.: 11/205,607

(22) Filed: Aug. 17, 2005

(65) Prior Publication Data

US 2007/0039168 A1 Feb. 22, 2007

(51) Int. Cl.
*H01R 43/00* (2006.01)

(52) U.S. Cl. ..... 29/753; 29/748; 29/758; 72/402

(58) Field of Classification Search ..... 29/729, 29/739, 745–748, 751–753; 72/410–412, 72/409.14, 427, 461, 453.15–453.16, 470, 72/402; 81/421, 90.1, 90.2, 126, 128
See application file for complete search history.

(56) References Cited

U.S. PATENT DOCUMENTS

| | | | | |
|---|---|---|---|---|
| 3,575,036 | A * | 4/1971 | Hoffman et al. | 72/402 |
| 3,713,322 | A | 1/1973 | Fischer | |
| 4,989,443 | A * | 2/1991 | Sawdon | 72/402 |
| 5,195,350 | A * | 3/1993 | Aikens et al. | 72/402 |
| 5,415,015 | A | 5/1995 | Klemmer et al. | |
| 5,490,406 | A * | 2/1996 | College | 72/30.1 |
| 6,324,884 | B1 | 12/2001 | Barjesteh | |
| 6,782,608 | B2 | 8/2004 | Ohsumi et al. | |
| 6,889,579 | B1 * | 5/2005 | Brown | 81/90.2 |
| 7,162,909 | B2 * | 1/2007 | Kelly et al. | 72/409.14 |
| 2004/0072378 | A1 | 4/2004 | Kelly et al. | |

FOREIGN PATENT DOCUMENTS

| | | |
|---|---|---|
| EP | 0415831 | 3/1991 |
| EP | 1542322 | 6/2005 |
| WO | WO 9725757 | 7/1997 |

* cited by examiner

*Primary Examiner*—Minh Trinh
(74) *Attorney, Agent, or Firm*—Bruce A. Jagger

(57) ABSTRACT

A crimping tool with a quick-change crimp head for sealing and electrically crimping electrical contacts to insulated wires. The crimping tool includes a base unit with a receptacle that is configured to actuate and removably and replaceably receive the quick-change crimp head. A crimping die holder body includes a plurality of crimp-seal and continuity-crimping dies. These dies are mounted for movement in the crimping die holder body between an open configuration and a fully crimped configuration. The crimp-seal dies have arcuate die faces that define a substantially closed generally cylindrical form when the dies are in the fully crimped configuration. Actuators are mounted in the base unit. The actuators are adapted to cause the dies to move in the body. A sensor system is configured to prevent the crimping tool from unintentionally repeating a crimping operation on the electrical contact, and to verify continuity-crimp depth of indentation.

18 Claims, 11 Drawing Sheets

82
144
40
92
148
150
152
154
156
64
158
62
106

92
148
62

148

152
138
150
154
170
120
156
26
23
158
168
23
130
162
164
166
44
54
160
146
142
132

Fig. 15
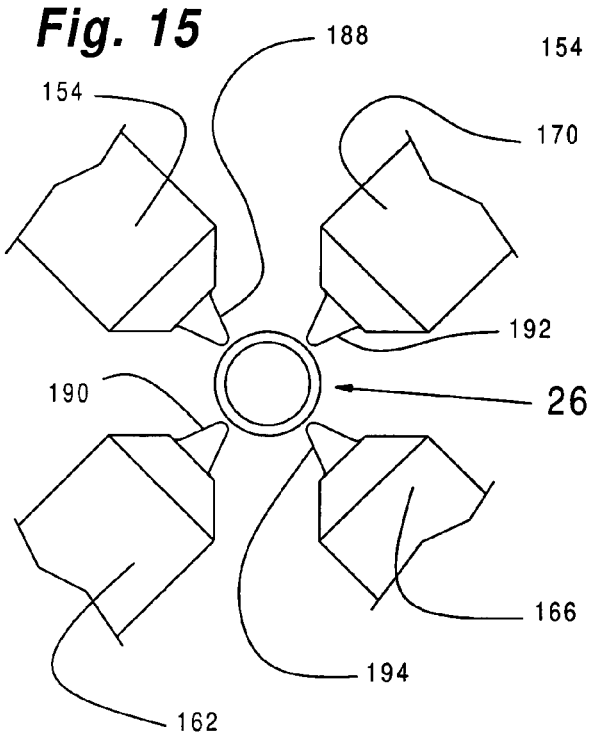
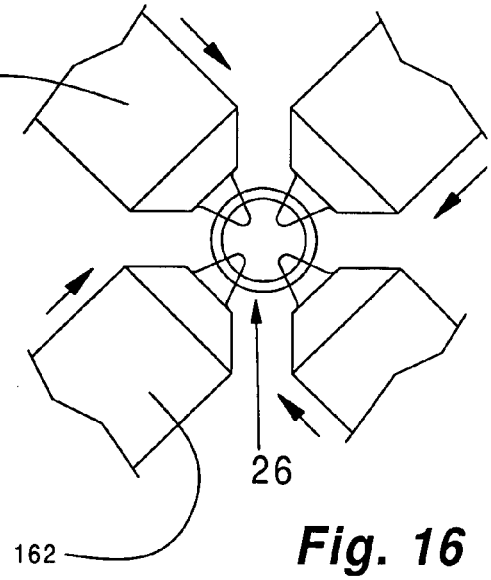
Fig. 16
Fig. 17
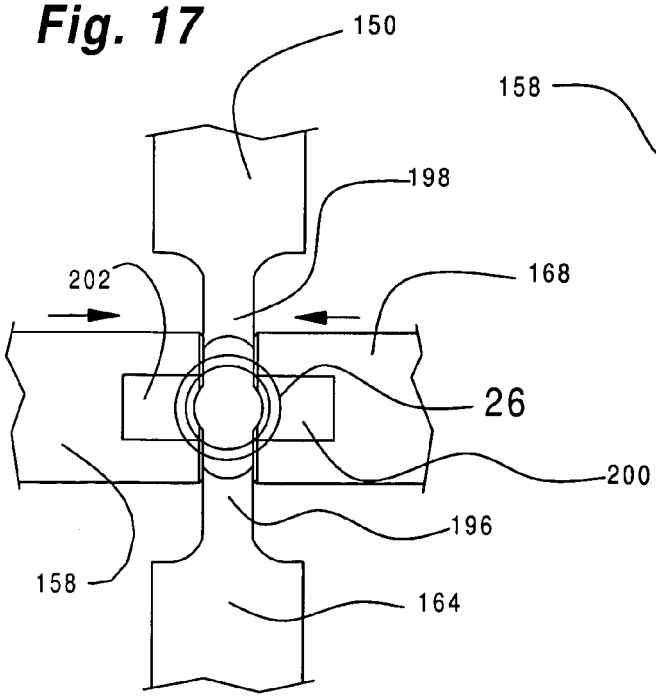
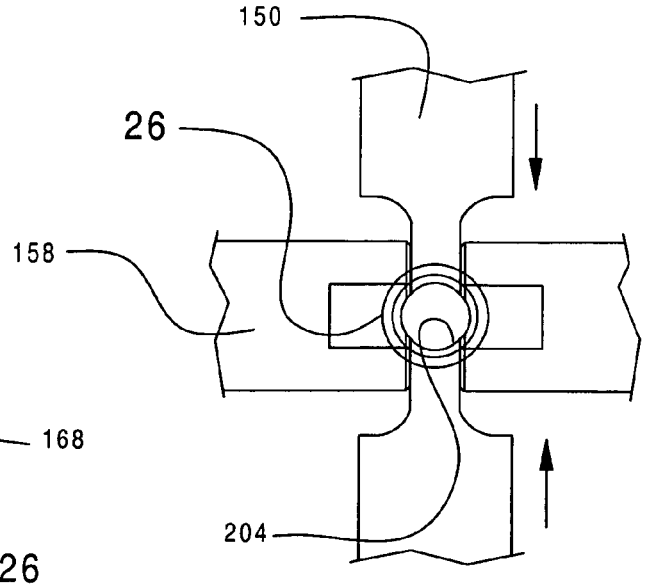
Fig. 18

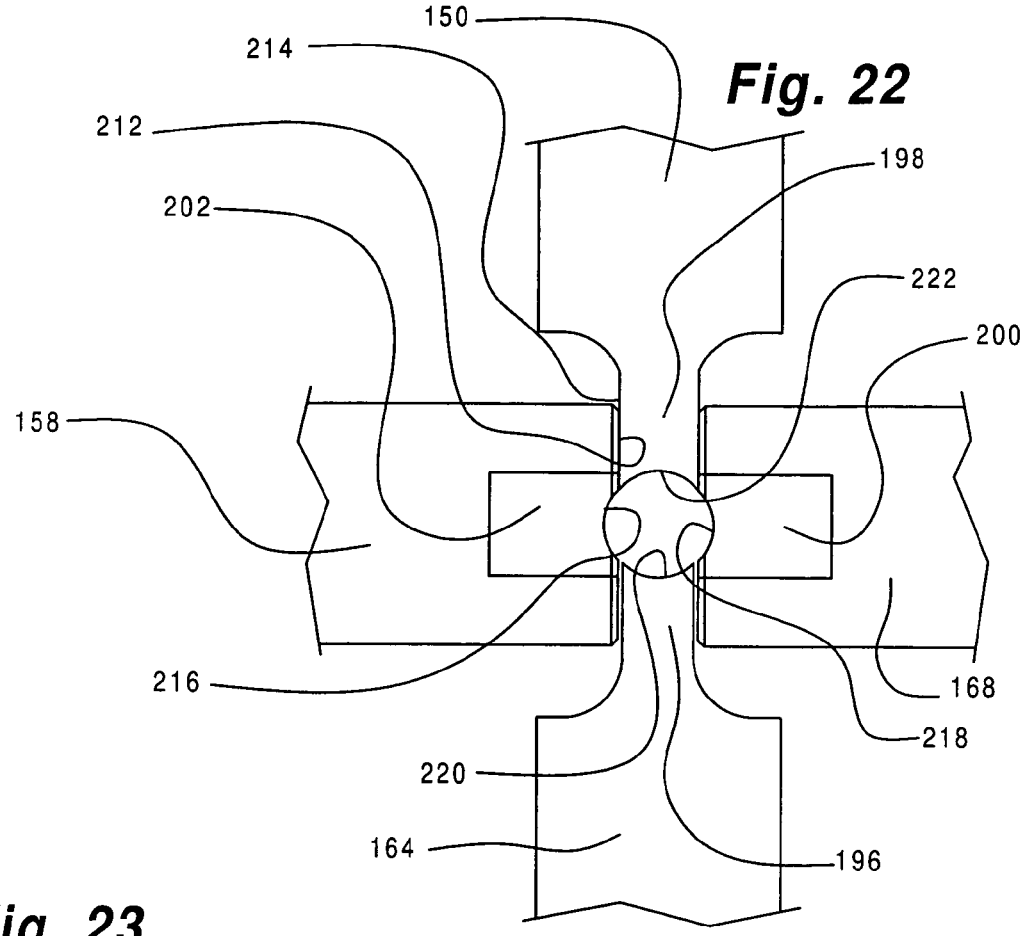
Fig. 22
Fig. 23
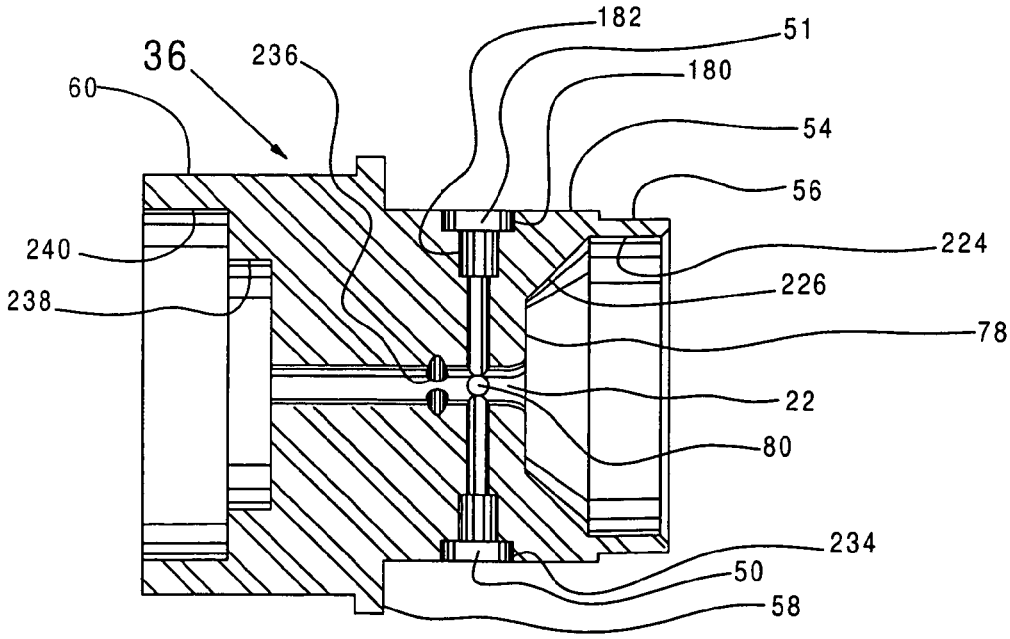

Fig. 25
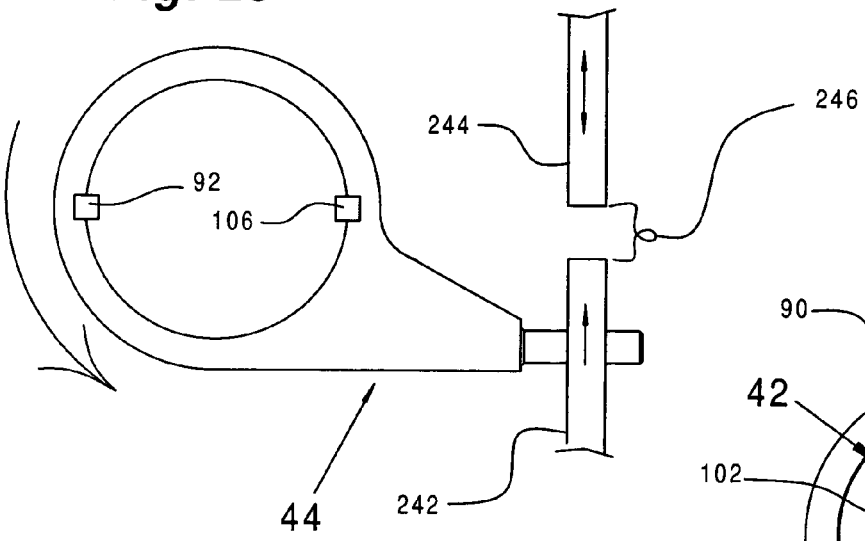
Fig. 26
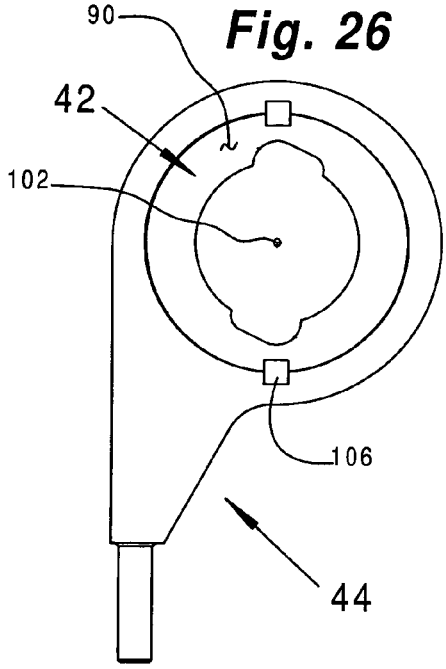
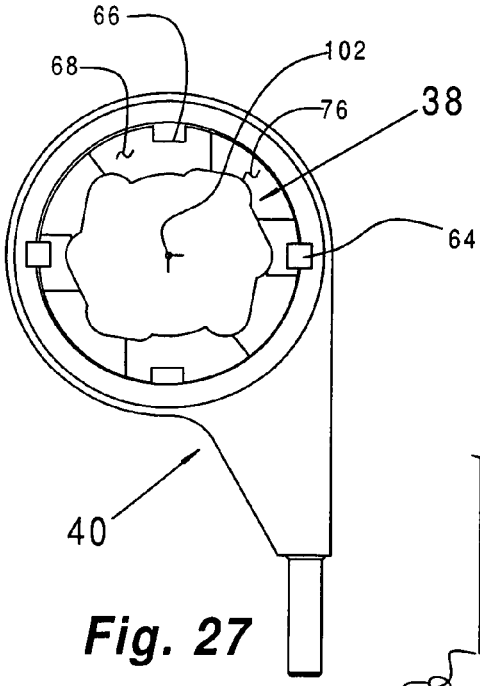
Fig. 27
Fig. 24
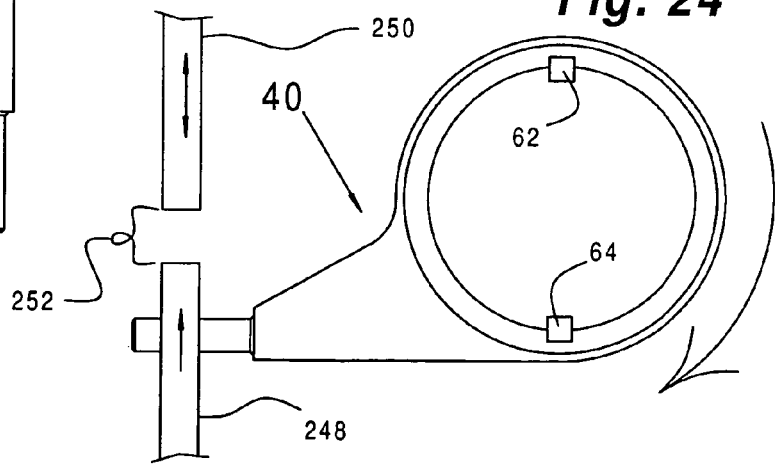

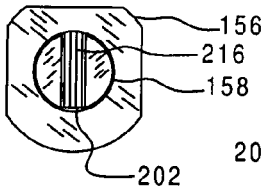
Fig. 29
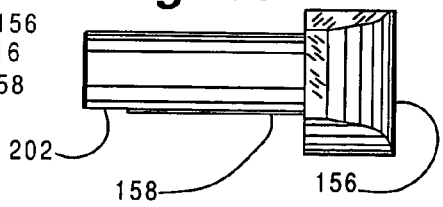
Fig. 30
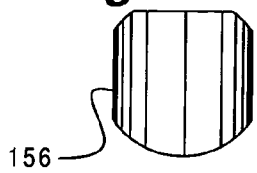
Fig. 28
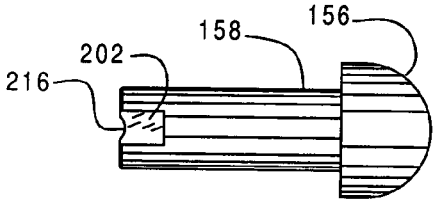
Fig. 31
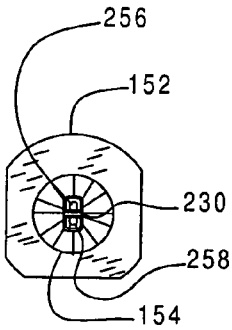
Fig. 33
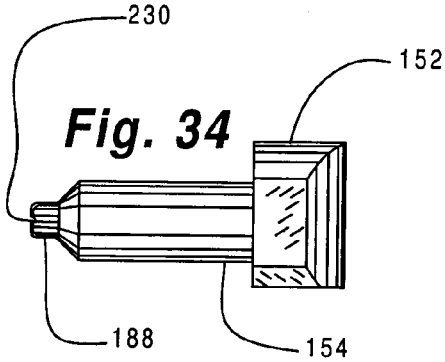
Fig. 34
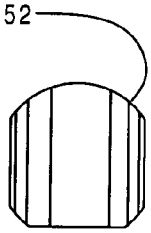
Fig. 32
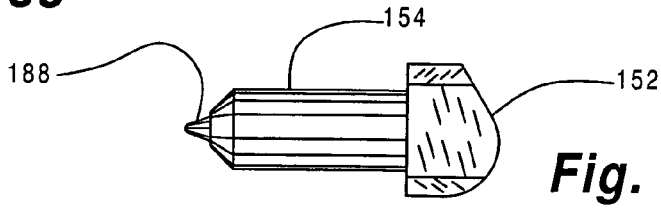
Fig. 35
Fig. 37
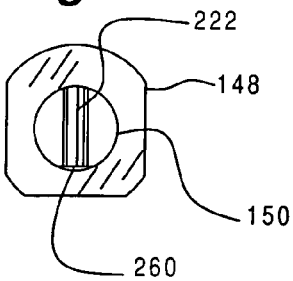
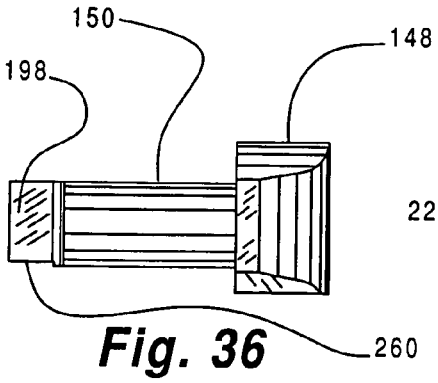
Fig. 36
Fig. 38
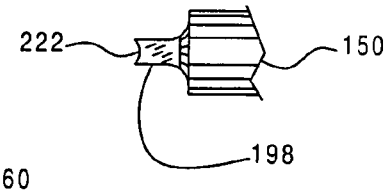

Fig. 39
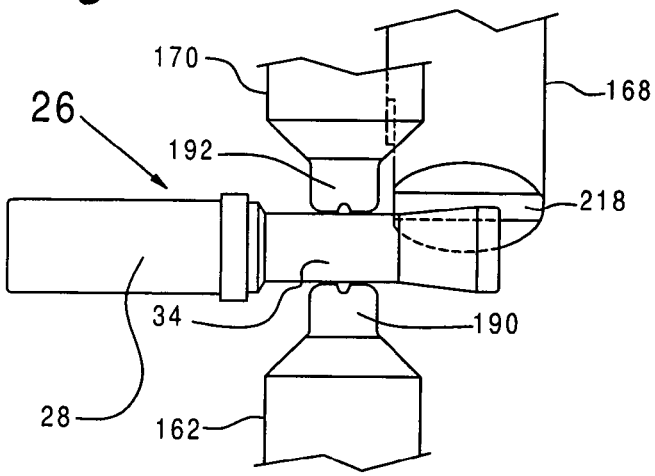
Fig. 41
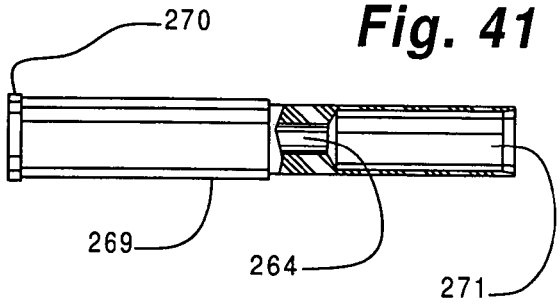
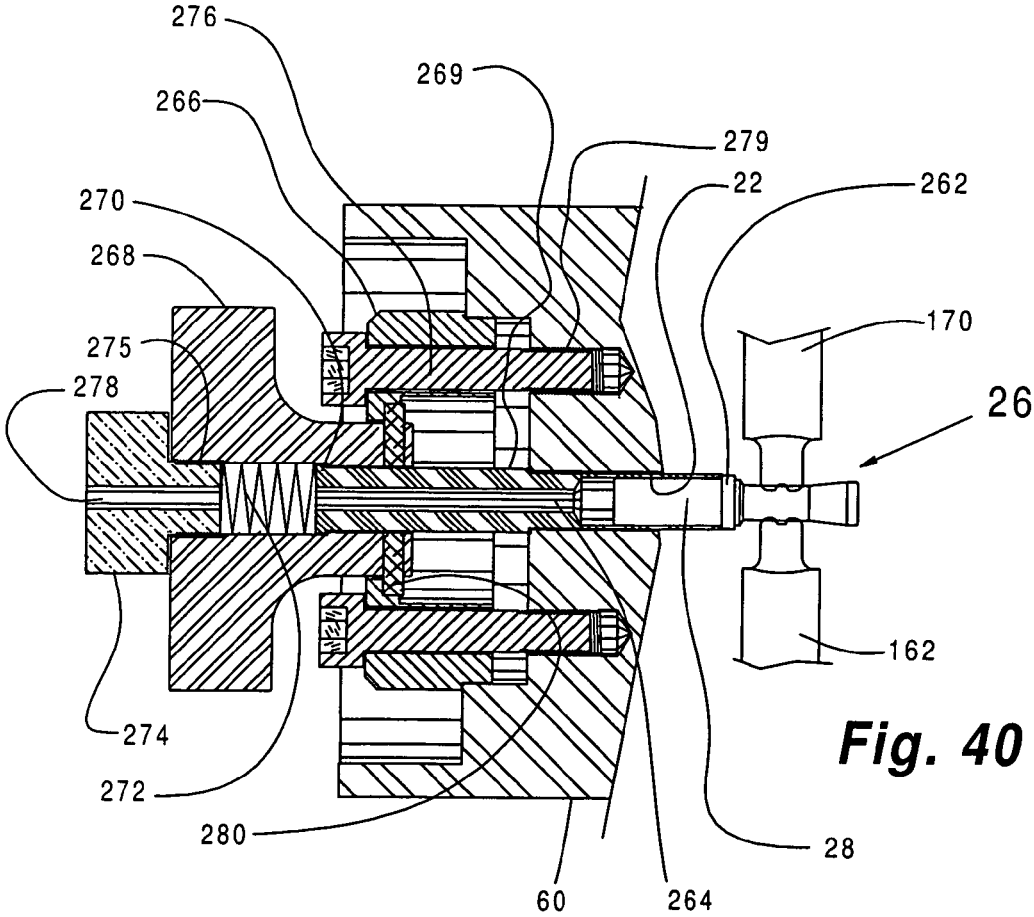
Fig. 40

CRIMPING TOOL WITH QUICK-CHANGE CRIMP HEAD FOR SEALING AND ELECTRICALLY CRIMPING ELECTRICAL CONTACTS TO INSULATED WIRE

BACKGROUND OF THE INVENTION

1. Field of the Invention

The invention relates in general to methods and devices for mounting an electrical contact to an insulated multi-strand or single strand wire and, more particularly, embodiments of the present invention relate to improvements in methods and devices for mounting contacts onto insulated multi-strand and single strand wires by indenting the contact into the multi-strand or solid wire to form an electrical contact, and crimping the contact around the insulation to form an hermetic seal between the insulation and the contact in one crimping cycle.

2. Description of the Prior Art

Multi-strand and single strand aluminum alloy wires have been widely used for various electrical wiring purposes, and recently in aircraft and aerospace applications where a reduction in the weight of the wiring is achieved by such use. Solid or multi-strand aluminum wires typically include a core of aluminum alloy metal strand(s) surrounded by a coating of flexible electrical insulation material. Aluminum and its alloys, for example, are typically susceptible to corrosion if the coating of insulation is broken. The insulation is always broken when the wires are cut to allow joinder to various fittings and contacts. The multi-strand and solid wire core projects beyond the cut insulation to permit direct electrically conductive connection with the contact. Such contacts typically are in the form of a pin that is adapted to plug into a socket to complete a desired circuit. It has been recognized that the connections between wires, particularly aluminum wires, and contacts should be made in such a way that the cut end of the coating is hermetically sealed to the electrical contact. This prevents moisture from entering the cut end and causing corrosion of the metal core. To this end, electric contacts for multi-strand and solid core electrical wires are typically designed so that a dual crimping action is required to mount them. One crimping action seals the contact to the coating of insulation, and another crimping action (indenting) forms the electrical connection between the metal core and the contact. Tools to accomplish this dual crimping action, particularly hand tools, had been previously proposed. See, for example, Kelly et al. US 2004/0072378, Pub. Apr. 15, 2004. Dual crimping of multi-strand electrical wires where hermetic sealing is not expected had been proposed. See, for example, Klemmer et al. U.S. Pat. No. 5,415,015, and Ohsumi et al. U.S. Pat. No. 6,782,608. Previous expedients were generally less than completely satisfactory because the crimp formed seals between the coating and the contact often failed. Also, the previous crimping equipment was generally time consuming to work with because it was difficult and time consuming to change crimping dies to accommodate different gauges of wire, crimper tool malfunctions, or the like. Such previous equipment was generally incapable of accommodating a full range of wire gauges with one tool. "Single wire gauge" crimp tools of various designs had been proposed. See, for example, Fischer U.S. Pat. No. 3,713,322 (four radially opposed dies actuated by a rotatable cam for crimping a contact to a multi-strand wire).

Those concerned with these problems recognize the need for an improved dual crimping tool.

BRIEF SUMMARY OF THE INVENTION

The present invention has been developed in response to the current state of the art, and in particular, in response to these and other problems and needs that have not been fully or completely solved by currently available crimping tools. Thus, it is an overall object of the present invention to effectively resolve at least the problems and shortcomings identified herein. In particular, it is an object of the present invention to provide a crimper tool wherein a crimping die holder is configured for quick and easy insertion and removal in a base unit. It is also an object of the present invention to provide a crimper tool that crimp forms a reliable hermetic seal between a contact and the insulative coating on a single or multi-strand core wire. It is a further object of the present invention to provide a crimper tool with an adjustable crimp depth. It is a further object of the present invention to provide a crimper tool with a sensor system that prevents the performance of a second crimping action on the same contact-wire assembly. Finally, it is an object of the present invention to provide a crimper tool wherein a crimping die holder is configured for quick and easy insertion and removal from a base unit, a sensor system prevents unintentionally performing two crimping cycles on the same contact and monitors the depth of the electrical crimp, and the crimping operation forms a substantially cylindrical hermetic crimp seal between a contact and the insulative coating on a single or multi-strand core wire. Embodiments of the present invention are particularly suitable for use in attaching contacts to single or multi-strand aluminum wire.

A preferred embodiment of the quick disconnect assembly according to the present invention comprises a bench mounted or hand-held crimping tool. A quick-change crimp head crimps a contact to a single or multi-strand core aluminum alloy wire to form both a reliable hermetic seal and good electrical continuity between the contact and the wire. The quick-change crimp head preferably slips axially in and out of a receptacle in a base unit. Between crimp cycles, the quick-change crimp head is generally held in the receptacle by the action of a latching or locking mechanism. The actuating mechanism for the quick-change crimp head is preferably located in the base unit. This placement of the actuating mechanism minimizes the mass, expense, and complexity of the quick-change crimp head. It also allows for very robust and flexible actuating mechanisms that are capable of accurately accommodating a wide range of wire gauges from, for example, 26 gauge or smaller to 12 gauge or larger. Typically, a separate quick-change crimp head is kept available for at least each wire gauge, and, if required, for each style of contact. When a particular wire gauge or contact style is to be crimped, the proper quick-change crimp head is selected and inserted into the receptacle. The mounting of a quick-change crimp head in a base unit by an experienced operator generally requires less than approximately a minute, and preferably, less than approximately 30 seconds. The actuating mechanism engages the quick-change crimp head when it is properly positioned in the receptacle portion of the base unit. A sensor system prevents accidentally applying two crimping cycles to the same contact-wire assembly and verifies continuity-crimp quality. Such sensor systems are conventional in the crimping art. The accidental application of more than one crimping cycle is conveniently prevented by requiring that the system be reset before it will perform another cycle. Crimp continuity is conveniently assured by providing a signal (audible, visual, tactile, or otherwise) to alert the operator if the contact is not indented to a predetermined depth during the cycle.

In an additional preferred embodiment, a base unit for an insulated single or multi-strand aluminum alloy wire crimping system includes a receptacle into which a quick-change crimp head may be slipped and locked. The crimp head includes a set of crimp-seal dies axially spaced from a set of continuity-crimping dies with both sets being mounted in a crimping die holder body. Both sets of dies perform crimping operations on the same contact-wire assembly. The crimp seal dies form the contact into a substantially smooth unbroken generally cylindrical wall hermetically sealed to the outside of the insulation on the core of the wire. The continuity-crimping dies crimp a wall of the contact into electrical contact with the core of the wire by indenting the wall into the wire. The dies are generally driven by ring cams. The ring cams have internal cam profiles, which engage cam followers that are associated with the respective dies. The contact is received in the die holder body in a contact holder. The contact holder is preferably quickly changeable. Preferably, the tool includes a sensor system. The sensor system prevents the crimping tool from unintentionally performing two crimping operations on the same contact-wire assembly, and detects non-compliant continuity-crimping.

The components of the quick-change crimp head typically include, for example, a die holder body in which several individual dies are mounted for reciprocal axial movement, one or more cam surfaces, typically, internal annular cam surfaces, and a contact holder. The contact holder, dies and ring cam(s) are removable and replaceable in the die holder body. Typically, the die holder body is non-rotatably mounted in the base unit and the actuating mechanism rotates the ring cam(s) to drive the dies into crimping engagement with the contact-wire assembly.

In a typical operation, a predetermined length of the end of a single or multi-strand core wire is stripped of its insulation. This stripping is performed in a separate preliminary operation. A contact is selected. Typically, the contact has an open end, and is otherwise completely closed. The exposed end of the core is inserted into the open end of the contact to such a depth that the insulation is located within the open end of the contact, and the exposed core is in a position to be crimped into conductive engagement with the contact. The contact with the wire so positioned within it is inserted into the contact holder in the quick-change crimp head. Sensors detect when the contact is properly positioned in the contact holder, and arm the system for one crimping cycle. The operator initiates the cycle. During the cycle the actuating mechanism rotates the cam ring(s) to cause linear motion of the associated dies in a predetermined sequence into crimping engagement with the contact. The walls of the contact are indented into conductive engagement with the bare wire core. The walls at the open end of the contact are formed into a generally unbroken cylinder clamped in a hermetic seal around a short length of the outside of the insulation. Preferably, a sensor associated with the actuating mechanical linkage detects the position of a particular moving element in the linkage at the end of the crimping stroke, and from this position the depth of the indentation is deduced. The contact wall must be indented to a predetermined depth to assure the desired electrical conductivity through the crimp.

When a crimp sensor detects that the proper depth of electrical crimp indentation has been reached, the actuating mechanism counter-rotates the cam ring(s) to allow the dies to withdraw from crimping engagement with the contact-wire assembly. This completes the cycle. The sensor prevents a second cycle from being inadvertently initiated until the system is armed again. The crimped contact-wire assembly is withdrawn from the contact holder. The sensor will rearm the system for another cycle when it senses a contact in the proper position in the contact holder.

To acquaint persons skilled in the pertinent arts most closely related to the present invention, a preferred embodiment of a crimping tool that illustrates a best mode now contemplated for putting the invention into practice is described herein by, and with reference to, the annexed drawings that form a part of the specification. The exemplary crimping tool is described in detail without attempting to show all of the various forms and modifications in which the invention might be embodied. As such, the embodiments shown and described herein are illustrative, and as will become apparent to those skilled in the arts, can be modified in numerous ways within the scope and spirit of the invention, the invention being measured by the appended claims and not by the details of the specification or drawings.

Other objects, advantages, and novel features of the present invention will become more fully apparent from the following detailed description of the invention when considered in conjunction with the accompanying drawings, or may be learned by the practice of the invention as set forth herein.

BRIEF DESCRIPTION OF THE DRAWINGS

The present invention provides its benefits across a broad spectrum of crimping applications. While the description which follows hereinafter is meant to be representative of a number of such applications, it is not exhaustive. As those skilled in the art will recognize, the basic apparatus taught herein can be readily adapted to many uses. This specification and the claims appended hereto should be accorded a breadth in keeping with the scope and spirit of the invention being disclosed despite what might appear to be limiting language imposed by the requirements of referring to the specific examples disclosed.

Referring particularly to the drawings for the purposes of illustrating the invention and its presently understood best mode only and not limitation:

FIG. 15 is a fragmentary diagrammatic plan view of four opposed continuity-crimp dies positioned to indent an electrical contact to establish electrical continuity between the contact and the multi-strand core of the wire.

FIG. 16 is a fragmentary diagrammatic plan view of four opposed continuity-crimp dies similar to FIG. 15 showing the continuity dies, relative to the uncrimped contact, in a position where crimping by indentation has been completed by axial movement of the dies toward the contact.

FIG. 17 is a fragmentary diagrammatic plan view of four opposed crimp-seal dies, two of which, relative to the uncrimped contact, have moved to a position where crimp sealing has been partially completed.

FIG. 18 is a fragmentary diagrammatic plan view of four opposed crimp-seal dies, all four of which, relative to the uncrimped contact, have moved to a position where crimp sealing has been completed.

FIG. 22 is a fragmentary diagrammatic plan view four opposed crimp-seal dies in the fully crimped configuration wherein the arcuate ends of the dies that crimpingly engage the surface of the contact form a substantially complete and unbroken cylinder.

FIG. 23 is a diagrammatic cross-sectional view of a die holder body without the dies and contact holder.

FIG. 24 is a diagrammatic plan view of a continuity-cam actuator and associated travel limiter mechanism.

FIG. 25 is a diagrammatic plan view of a crimp-seal cam actuator and associated travel limiter mechanism.

FIG. 26 is a diagrammatic plan view of a crimp-seal cam actuator with an associated crimp-seal cam.

FIG. 27 is a diagrammatic plan view of a continuity-cam actuator with an associated continuity-crimp cam.

FIG. 28 is a diagrammatic top view of a crimp-seal die showing the cam follower.

FIG. 29 is a diagrammatic bottom view of the crimp-seal die of FIG. 28.

FIG. 30 is a diagrammatic front view of the crimp-seal die of FIG. 28.

FIG. 31 is a diagrammatic side view of the crimp-seal die of FIG. 28.

FIG. 32 is a diagrammatic top view of a continuity-crimp die.

FIG. 33 is a diagrammatic bottom view of the continuity-crimp die of FIG. 32.

FIG. 34 is a diagrammatic front view of the continuity-crimp die of FIG. 32.

FIG. 35 is a diagrammatic side view of the continuity-crimp die of FIG. 32.

FIG. 36 is a diagrammatic front view of the crimp-seal die.

FIG. 37 is a diagrammatic bottom view of the crimp-seal die of FIG. 36.

FIG. 38 is a fragmentary diagrammatic side view of the crimp-seal die of FIG. 36.

FIG. 39 is a fragmentary diagrammatic side view of two opposed continuity-crimp dies, one crimp-seal die, and an electrical contact in the configuration they would enjoy in a die holder body in the initial phase of performing a crimping operation with the indenters just touching the contact.

FIG. 40 is a fragmentary diagrammatic view partially in cross-section of a die holder body where a contact is mounted in a contact holder. Two opposed continuity-crimp dies are shown in the positions they would occupy at the bottom of the indenting stroke. The uncrimped contact is shown so the depth of indentation of the contact side wall is apparent. The contact holder is mounted in the die holder body. The structure that permits quickly changing from one contact holder to another is diagrammatically illustrated.

FIG. 41 is a diagrammatic view partially in cross-section of a contact holder that is typically mounted in a die holder body to receive and hold an electrical contact for the performance of a crimping operation

DETAILED DESCRIPTION OF THE PREFERRED EMBODIMENTS

Figure 4:
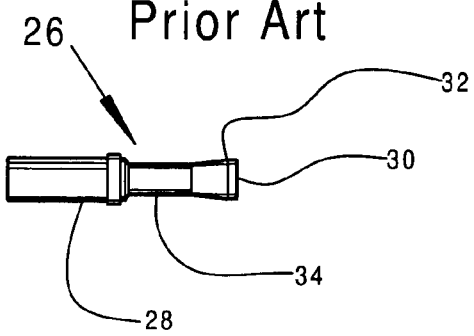
Fig. 4 Prior Art
FIG. 4 is a side view of a typical prior art electrical contact in the uncrimped configuration for use with a multi-strand core wire.
Figure 3:
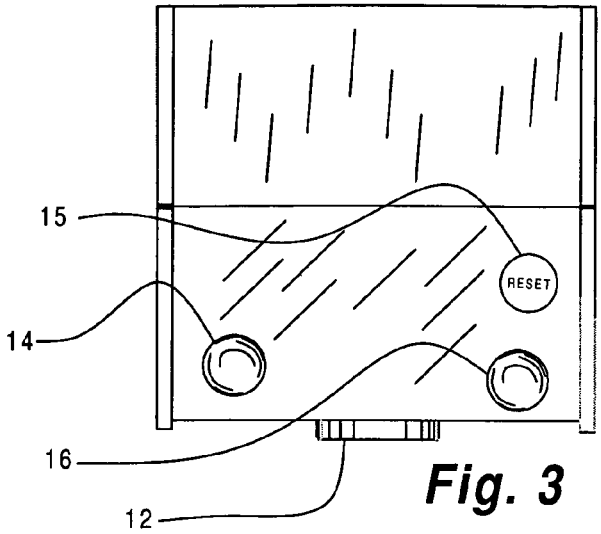
FIG. 3 depicts a top view of the embodiment of FIG. 1.
Figure 2:
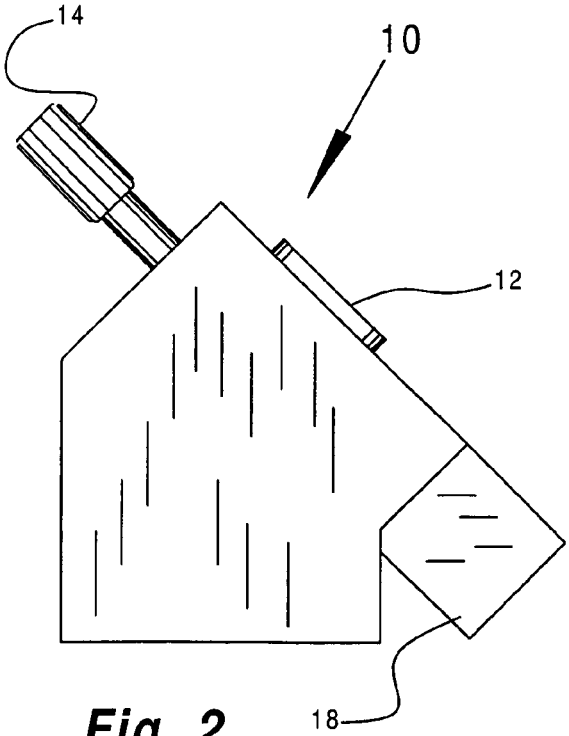
FIG. 2 depicts a side view of the embodiment of FIG. 1 in the orientation it would normally enjoy when resting on a bench.
Figure 1:
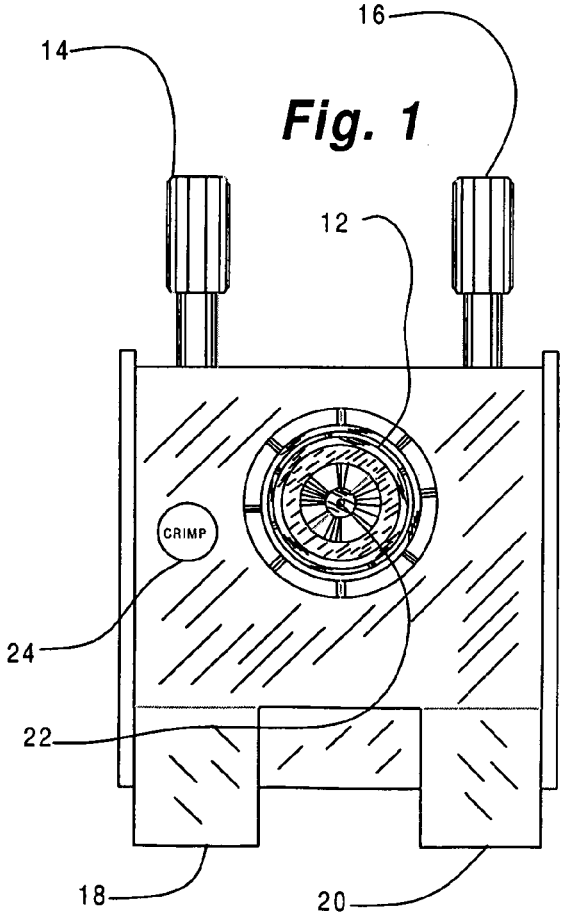
FIG. 1 is a front view of a preferred embodiment of the invention showing a bench mountable crimping tool with a quick change crimp head that is capable of dual crimping an insulated multi-strand core wire to an electrical contact.

Referring now to the drawings wherein like reference numerals designate identical or corresponding parts throughout the several views. It is to be understood that the drawings are diagrammatic and schematic representations of various embodiments of the invention, and are not to be construed as limiting the invention in any way. The use of words and phrases herein with reference to specific embodiments is not intended to limit the meanings of such words and phrases to those specific embodiments. Words and phrases herein are intended to have their ordinary meanings, unless a specific definition is set forth at length herein.

For purposes of illustration, a bench mounted embodiment of the invention has been shown. It will be understood by those skilled in the art that hand held embodiments of the present invention may be used for lighter gauges, for example, smaller than approximately 18 gauge. For heavier gauges, for example, 14 gauge and heavier, it preferable to use a bench mounted embodiment. The force required to crimp, for example, a 12 gauge wire, generally requires driving motors and linkages that are too large and/or heavy to be mounted in a hand held device. A bench mounted unit is more versatile in that it can crimp all gauges from the lightest to the heaviest, whereas a hand held embodiment is generally limited to the lighter gauges.

Referring particularly to the drawings, there is illustrated generally at 10, a base unit with a receptacle in which a quick-change crimp head 12 is mounted. The base unit is adapted to rest on a bench or other surface. Base unit 10 includes crimping stroke adjusting micrometers 14 and 16, and crimp actuating motors 18 and 20. Motors 18 and 20 are typically either electrical or pneumatic motors. Particularly for hand held devices, the activating electricity may be supplied by batteries, if desired. Hand held devices may also be pneumatically activated, if desired. Stroke adjusters 14 and 16 serve to permit very accurate adjustment of the depth of the crimp. This is particularly useful for example, for making prototypes, for short runs, and in adjusting for wear. Stroke adjusters are not necessarily required or even desirable in mass production operations. A crimping cycle is initiated, for example, by pushing a crimp button 24. Crimping cycles may be initiated in other ways, if desired. Actuating motors 18 and 20 drive the crimping dies. The actuating motors should have sufficient capacity to drive the crimping dies regardless of the gauge of the wire or the nature of the material that is deformed in the crimping operation. For purposes of quality control, and the like, a sensor system is preferably provided. Such sensor systems typically serve to prevent the performance of two crimping operations on the same contact-wire assembly, and detect whether the indenter has traveled the full predetermined length of the indenting stroke. Such sensor systems are conventional in the crimping art, and they are not shown here. If it is desired to override the sensor system and manually reset the system, a reset button 15 is provided. Axial bore 22 extends axially through the center of quick-change crimp head 12.

With particular reference to FIG. 4, a typical contact 26 is generally hollow and cylindrical in form, and composed of an electrically conductive material such as, for example, metal. The end 28 is designed to fit into an electrical socket to complete an electrical circuit. The generally cylindrical wall of the mid-section 34 is designed to be crimped into electrically conductive engagement with a bare wire core. The hollow contact is open at open end 30. The contact wall surrounding the open end 30 is preferably belled to facilitate the introduction of a wire into the hollow interior of contact 26, and to accommodate the insulated coating on the wire. In general, the stripped end of a wire is inserted far enough into contact 26 to place the end of the insulation within generally frustoconical wall section 32. The walls of the contact 26 are generally malleable enough that the necessary crimping operations may be performed without rupturing them. When open end 30 is hermetically sealed to a coating of insulation on a wire (not shown), the interior of contact 26 is sealed against the entry of moisture. Corrosion of the wire core is thus prevented. The electrically conductive characteristics of the contact-wire assembly are thus reliably maintained at predetermined values.

Figure 5:
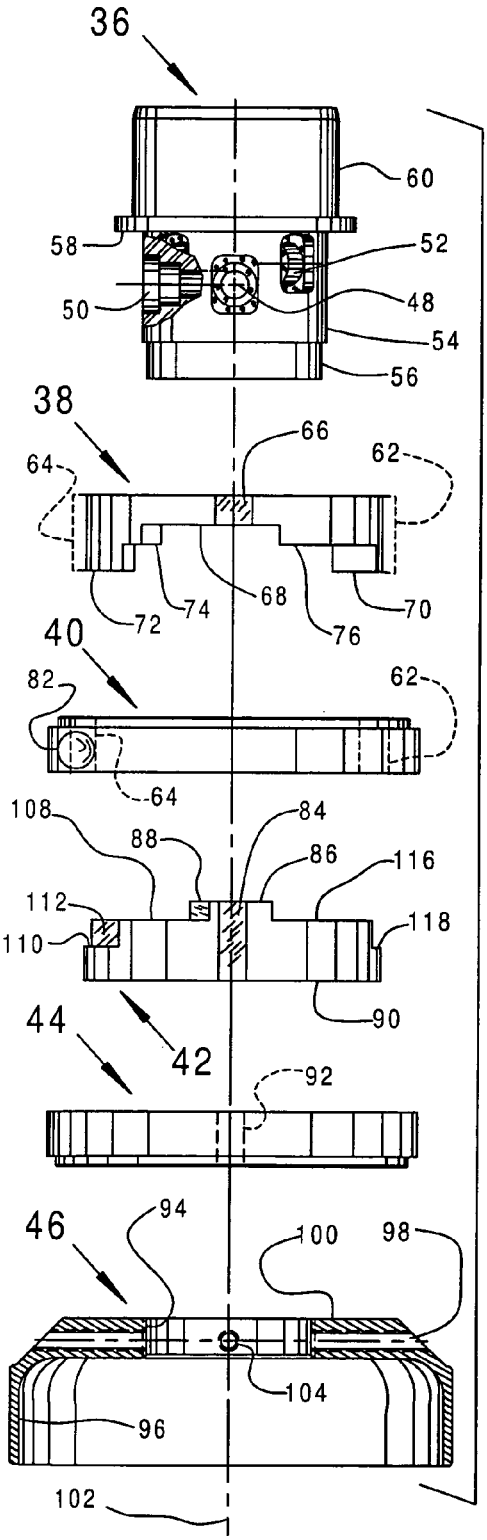
FIG. 5 is an exploded view of a quick change crimp head according to the present invention.
Figure 6:
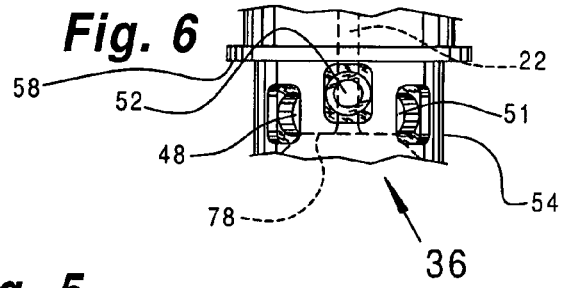
FIG. 6 is a fragmentary view of the die holder body rotated approximately 45 degrees counterclockwise from that shown in FIG. 5.
Figure 7:
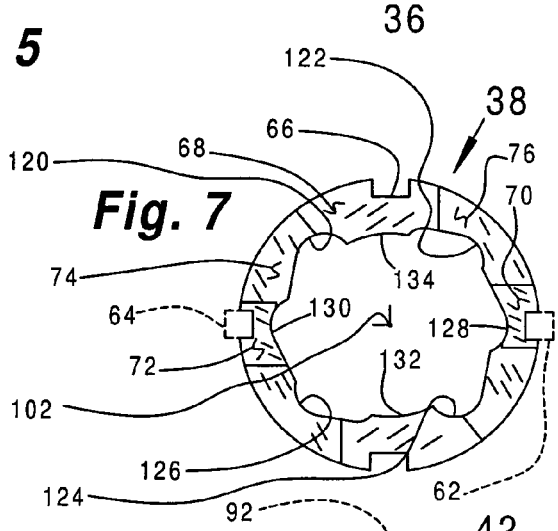
FIG. 7 is a plan view of the continuity-crimp die actuating cam shown in FIG. 5 that is associated with both crimp sealing the insulation to the electrical contact and crimping the contact to the wire core for electrical continuity purposes. The profile of this continuity-crimp die cam is such that its active surfaces serve to actuate six dies, namely, four continuity-crimp dies and two crimp-seal dies.
Figure 8:
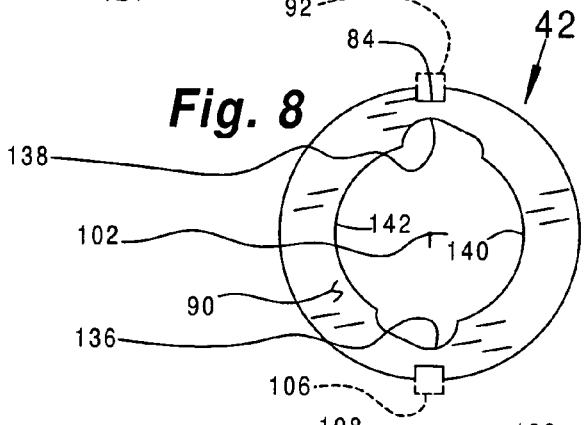
FIG. 8 is a plan view of the crimp-seal die actuating cam shown in FIG. 5 that is associated with crimping the contact to the wire core. The profile of this crimp-seal die cam is such that its active surfaces serve to actuate two crimp-seal dies.
Figure 9:
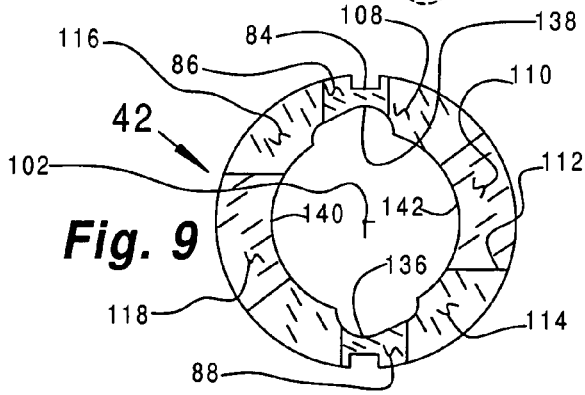
FIG. 9 is a view of the opposed side of the crimp-seal die actuating cam shown in FIG. 8.

With particular reference to FIGS. 5-9, there is illustrated generally at 36, a die holder body for use in quick-change crimp head 12. Die holder body 36 includes a plurality of generally radial bores (die bores) of which 48, 50 and 52 are typical that intersect with axial bore 22. FIG. 6 illustrates the positioning of the radial bores when body 36 is rotated approximately 45 degrees counterclockwise from the position shown in FIG. 5. Die bores 50 and 51 are generally radially opposed to one another. There are generally two sets of die bores axially offset from one another. The most axially proximal of the die bores, of which 48, 50, and 51 are typical, are adapted to mount radially opposed crimp-seal dies. The most axially distal of the die bores, of which 52 is typical, are adapted to mount radially opposed continuity-crimping dies. Generally, cylindrical external surface 60 is adapted to slip axially of longitudinal axis 102 into a receptacle in base unit 10 to removably and replaceably mount quick-change crimp head 12 in base unit 10.

There is indicated generally at 38 (FIGS. 5 and 7) a continuity-crimping cam. Cam 3.8 has a generally annular flat radially extending face that is adapted to bear slidably against the generally flat annular radially extending ring surface 58 of body 36. A continuity-crimping cam actuator is indicated generally at 40 (FIGS. 5, 10, 24 and 27). Actuator 40 is adapted to encircle cam 38. Actuator 40 and cam 38 are keyed together by keys 62 and 64 received in mating keyways in actuator 40 and cam 38. Actuator 40 and cam 38 are thus rotatably locked together, but are separable by axial movement relative to one another. Lever arm 82 (FIGS. 5 and 10) projects generally tangentially from actuator 40. Movement of lever arm 82 causes actuator 40 and cam 38 to rotate around longitudinal axis 102. The nature of the structure is generally such that such rotation is generally through an arc of limited length. Cam 38 is formed with several lands that project axially for different axial lengths so as to present axially facing surfaces 68, 70, 72, 74, and 76. These axially facing surfaces generally face towards the proximal end of the quick-change crimp head 12. The sides of the lands, of which 112 is typical, generally extend parallel to the longitudinal axis 102.

Figures 10, 11, 12:
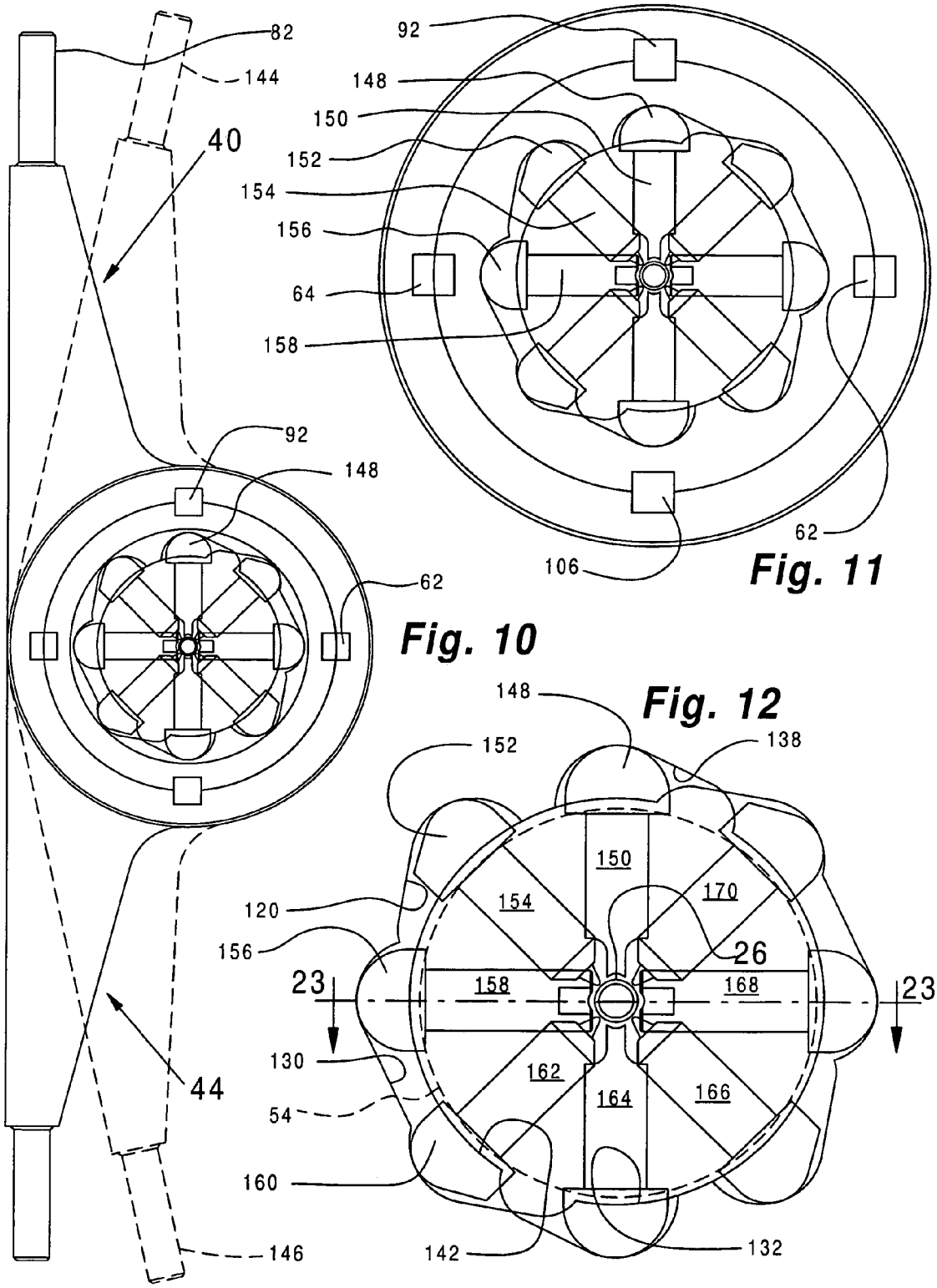
FIG. 10 is a diagrammatic see-through plan view of a quick change crimp head showing all of the crimping dies operatively mounted in cam actuators.
FIG. 11 is a diagrammatic see-through plan view of a quick change crimp head showing all of the crimping dies operatively mounted in cam actuators with associated actuating mechanisms.
FIG. 12 is a diagrammatic see-through plan view of a quick change crimp head showing all eight of the crimping dies operatively mounted with associated cam surfaces.

A crimp-seal cam is indicated generally at 42 (FIGS. 5 and 8), and an associated crimp-seal cam actuator is indicated generally at 44 (FIGS. 5 and 10). Cam 42 is nested within actuator 44 for rotation therewith by means of the engagement of keys 92 and 106 in mating keyways in Cam 42 and actuator 44. Keyway 84 in cam 42 is typical of such mating keyways. Cam 42 includes several lands of different axial lengths. These lands terminate in generally axial facing surfaces 86, 88, 108, 110, 114, 116, and 118. These surfaces generally face the distal end of quick-change crimp head 12.

The actuators 40 and 44 are preferably mounted so that when actuated, they cause cams 38 and 42 to counter-rotate relative to one another. Preferably, cam 38 is rotated first to cause the electrical continuity crimping action and the first phase of the crimp sealing operation to be performed. Cam 38 is held in the rotated position and cam 42 is then rotated to cause the performance of the second phase of the crimp sealing operation. Mounting the actuators in the base unit allows the actuators themselves and the drivers for them to be very robust. If, by reason of the use of large sizes or materials that strongly resist deformation, or for any other reason, substantial force is required to perform a crimping operation, that substantial force is available without modification of the base unit. The appropriate quick-change crimp die is inserted into the receptacle, and the equipment is ready for use.

A handle indicated generally at 46 includes a generally cylindrical proximally projecting wall 96, which permits an operator to grasp the quick-change crimp head 12 for easy removal and insertion into a receptacle in base unit 10. Axial bore 94 of handle 46 slips over generally cylindrical surface 56 of body 36. Threaded radially extending holes of which 98 and 104 are typical serve to threadably mount set screws (not shown). These set screws bear against surface 56 to securely but releasably mount handle 46 to body 36 with cams 38 and 42, and actuators 40 and 44 trapped between surface 58 and radially extending face 100 of handle 46.

In the assembled configuration, cams 38 and 42 are rotatably journaled on generally cylindrical surface 54 of body 36.

Generally cylindrical internal surfaces 132 and 134 of cam 38, and generally cylindrical internal surfaces 140 and 142 of cam 42 are rotatably journaled on generally cylindrical external surface 54 of body 36. The lands of the respective cams are interengaged so that adjacent axially facing surfaces of cams 38 and 42 are in generally slidable engagement with one another. For example, face 116 of cam 42 slidably engages face 76 of cam 38, and face 110 of cam 42 slidably engages face 72 of cam 38. Surface 90 of cam 42 slidably engages face 100 of handle 46. The lands of the respective cams are of such an arcuate extent that they permit the respective cams to rotate relative to one another without interference through a short arc that is sufficient for crimping purposes. During a crimping cycle, the cams oscillate about the longitudinal axis 102 between open and crimped configurations.

Actuators 40 and 44 are preferably mounted in base unit 10, and the connecting keys, for example, 62 and 92, are preferably mounted in the respective actuators. Thus, a quick change crimp head 12 preferably comprises body 36 with selected crimp dies mounted in associated die bores, for example, 48, 50, and 52, and cams 38 and 42, all held in the assembled configuration by handle 46. Rectangular cut-out 66 in the outer perimeter of cam 38 is proportioned to permit it to slid unobstructed past key 92 in actuator 44 as the head 12 is removed and inserted axially into the receptacle in base unit 10.

The internal surfaces of cams 38 and 42 are shaped to provide cam surfaces. Cam 38 includes six cam surfaces, four of which (122, 126 and 120, 124) are positioned to camingly engage four radially opposed continuity-crimping dies. The remaining two cam surfaces (128, 130) are positioned to camingly engage two of four radially opposed crimp-seal dies. The internal surface of cam 42 includes two cam surfaces (136-138). The two cam surfaces (136-138) in cam 42 are adapted to camingly engage the two remaining radially opposed crimp-seal dies. The cam surfaces 128-130 are formed in an axially projecting face of the most proximally extending lands of cam 38 and project to surfaces 70 and 72, and cam surfaces 136-138 are similarly formed in an axially projecting face of the most distally extending lands of cam 42 and extend to surfaces 88 and 86, respectively. By so positioning these cam surfaces in the faces of these axially overlapping lands, these cam surfaces are positioned to drive radially opposed crimp-seal dies that are mounted in radially opposed die bores in body 36. The axially inter-extending lands on the respective cams accommodate the axial offset between the crimp-seal and continuity-crimping die bores. Six of the dies, two of which are axially offset from the others, are actuated by one cam. The inter-extending lands permit the axially offset dies to be actuated by this one cam. The cam profiles determine the strokes of the dies.

Figure 13:
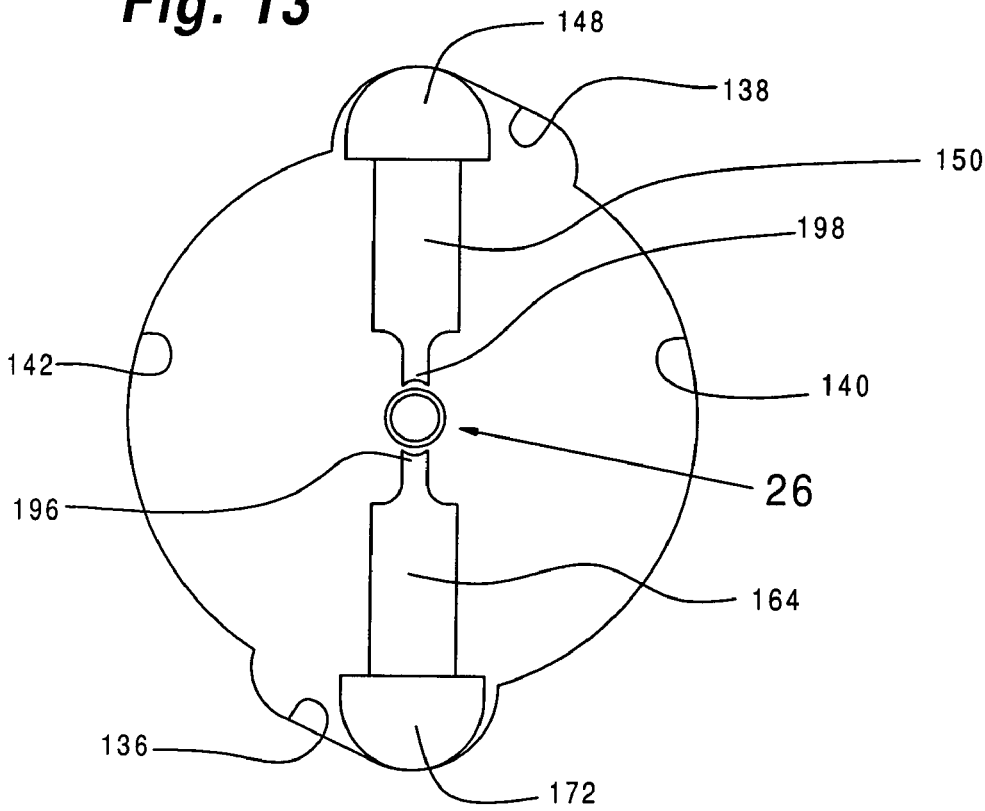
FIG. 13 is a diagrammatic see-through plan view of two opposed crimp-sealing dies fully retracted from a contact and an associated crimp-seal cam surface.
Figure 14:
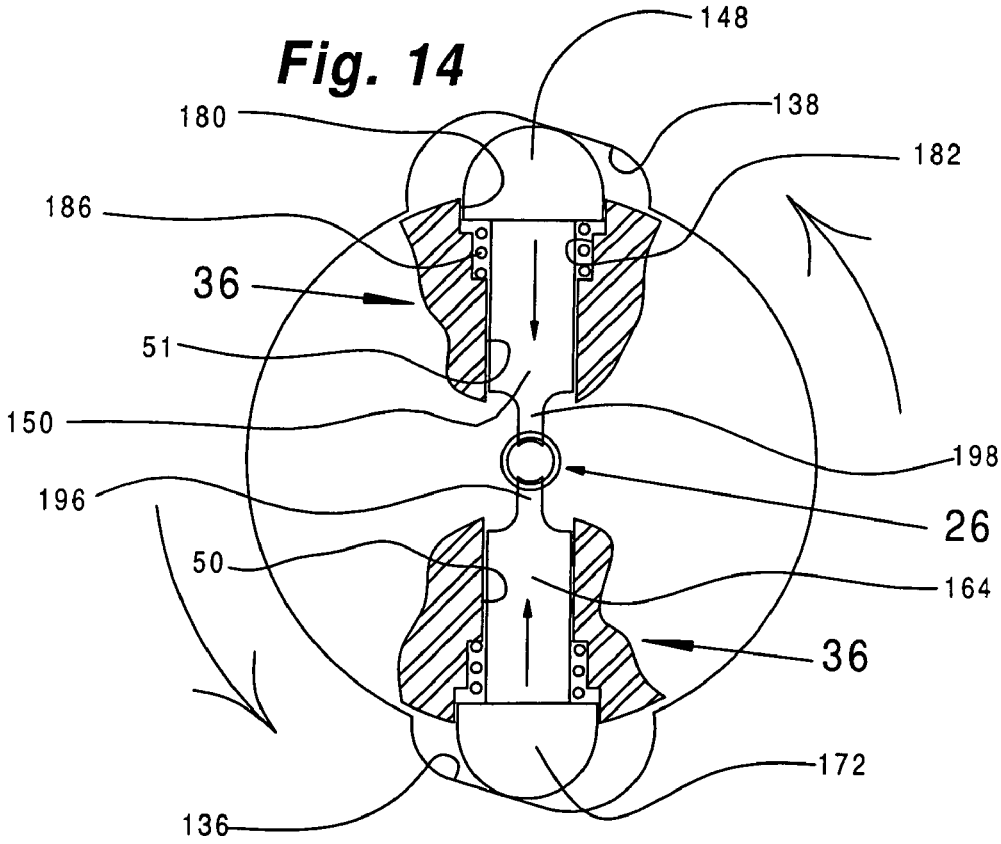
FIG. 14 is a diagrammatic see-through plan view similar to FIG. 13 including fragmental cross-sections of a die holder body with the opposed crimp-seal dies in a position where crimping has occurred due to counterclockwise rotation of the cam surface.

With particular reference to FIGS. 10-14, the relationships between the cams, the actuators, the crimping die holder body, and the crimping dies is schematically illustrated. In FIG. 10 the arms of the actuators and the engagement of the keys in the respective keyways is illustrated. In FIG. 11 the arms of the actuators are not shown so as to permit clearer schematic illustration of the relationships between the remainder of the structure. In FIG. 12 the relationships of the cam surfaces, the dies and the contact 26 are schematically illustrated. In FIG. 13, just two of the crimp-seal dies and the associated cam surface are illustrated. In FIG. 14, the two crimp-seal dies of FIG. 13 are shown in a crimping configuration with part of the associated crimping die holder body and cam surface.

The movement of actuator 40 through a short arc to the position shown at 144 (FIG. 10) causes the wall of a contact and the multi-strand or solid core or the like of a wire to be fully crimped together. Such crimping typically involves indenting the wall of the contact into the single or multi-strand wire. The wall of the contact exhibits little or no resilience so the indentation remains when the crimp forming dies are withdrawn. Reliable and repeatable electrical continuity is thus provided for each contact-wire assembly that is subjected to such a crimping operation. In the embodiment chosen for purposes of illustrating the invention, this movement also performs the first stage of making a crimp-seal. Likewise, the movement of actuator 44 to the position shown at 146 causes the completion of a crimp-seal between a contact and the coating of insulation on a wire. The seal here serves to exclude moisture vapor from contact with the exposed bare end of wire. Because it excludes moisture, this crimp-seal is described as a hermetic seal.

The respective crimp forming dies are driven reciprocally in the crimping die holder body 36 by the interaction between cam followers, of which 148, 152, 156, and 160 are typical. Cam follower 148 is mounted to die shaft 150. Similarly, cam followers 152, 156, and 160 are mounted to die shafts 154, 158, and 162, respectively. Die shafts 164, 166, 168, and 170 are likewise provided with associated cam followers. The length of the stroke through which the die shafts travel during a crimping operation is determined by the profile of the cam surface and the length of the arc through which the associated actuator travels during the crimping cycle. The length of the respective cycle arcs is conveniently adjusted for each actuator by, for example, adjusters 14 and 16, respectively.

In the embodiment chosen for illustration, the cam followers and die shafts are all one piece. This is not a required configuration. The cam followers and die shafts may be separate from one another, if desired, so long as they interact to accomplish the crimping operations.

When actuator 40 is moved arcuately to position 144, the engagement of keys 62 and 64 with the continuity-crimping cam 38 cause it to rotate clockwise about axis 102 to drive, for example, cam surface 120 over cam follower 152. This causes die shaft 154 to move radially towards contact 26. The clockwise rotation of cam 38 also causes, for example, cam surface 130 to camingly engage cam follower 156, which in turn drives die shaft 158 radially towards contact 26. The counter-clockwise rotation of actuator 44 to position 146 causes crimp-seal cam 42, acting through cam surfaces 138 and 136 and associated cam followers 148 and 172, respectively, to camingly actuate die shafts 150 and 164, respectively. The actuator 44 acts on cam 42 through the inter-engagement of keys 92 and 106. The crimp-seal die faces of die heads 198 and 196 are generally cylindrically concave. The counter-clockwise rotation of the cam that actuates them forces these faces to the fully crimped configuration shown, for example, in FIG. 14. In FIG. 14 the contact 26 is shown in its uncrimped form with the die heads 198 and 196 superimposed. This visual comparison of the uncrimped contact with the fully actuated dies makes apparent the degree of deformation that occurs as a result of the crimping operation.

With particular reference to FIG. 15, where the continuity-crimping dies are shown fully retracted, and FIG. 16, where the dies are shown fully extended, the positions of the die heads 188, 192, 194, and 190 are shown relative to the contact 26. In the fully retracted position of FIG. 15, the contact 26 may be freely removed and inserted. In the fully crimped position shown in FIG. 16, the depth of the indentation formed during crimping relative to the uncrimped contact 26 is apparent. The dies reciprocate between these two positions during a crimping cycle. The cycle starts with the dies in the position of FIG. 15, move through the position of FIG. 16, and back to the position of FIG. 15 at the end of the cycle.

With particular reference to FIG. 17, where the positions of the crimp-seal dies at the end of the first half of a crimp cycle are shown, and FIG. 18, where the dies are shown in the fully closed or crimped configuration, the positions of the die heads relative to the contact 26 are shown. The contact 26 is shown in the uncrimped form in both Figs so as to illustrate the degree of deformation of the contact that takes place. The crimp-seal die faces on the crimping ends of die shafts 158 and 168 are actuated by cam 38 in the first half of the crimp-seal forming operation. These faces have both flat and arcuate areas. These compound faces perform two functions. The flat areas serve to closely and slidably engage the sides of crimp-seal die heads 196 and 198, and the generally concave cylindrical areas in portions 200 and 202 serve to form a generally cylindrical crimp. These flat areas on the sides of die heads 196 and 198 slidably engage the mating flat areas on the compound ends of the opposed die heads so that there is substantially no space between them. Thus, when they fully close together, as shown in FIG. 18, there is no room for the metal of the contact to extrude between them. The arcuate surfaces at the ends of the crimp-seal die heads form a substantially unbroken cylinder 204 in the fully crimped configuration. This substantially closed generally cylindrical form prevents the formation of channels in the crimped contact through which moisture might migrate. This is important in achieving an hermetic seal. During the crimping operation, the metal of the contact 26 is caused to shrink around the coating of insulation to form a smooth unbroken cylinder. If desired the crimp-seal could be given a slightly-tapered form, for example, a smooth unbroken somewhat frustoconical form. As used herein, "generally cylindrical" as applied to the form of the crimp-seal and crimp-seal forming dies is intended to include slightly tapered forms, and forms that include axially extending sections that are straight and axially extending sections that are tapered in the same crimp seal.

In the embodiment chosen for purposes of illustration, the die shafts are received for reciprocal sliding motion in cylindrical bores of which 50 and 51 (FIG. 14) are typical. For purposes of withdrawing the die after a crimping operation is performed, a compression coil spring, of which 186 is typical, is provided. Spring 186 is located in annular spring pocket 182. Spring pocket 182 generally shares a common longitudinal axis with bores 51 and 50. Spring 186 bears in compression against the underside of cam follower 148. Cam follower 148 is forced to move radially inwardly by engagement with surface 138 during a crimping operation. As cam surface 138 is rotated clockwise during the withdrawal phase of a crimping cycle, spring 186 forces cam follower 148 to follow cam surface 138. The cam followers, of which 148 is typical, are received in generally rectangular pockets, of which 180 is typical. The rectangular nature of the pocket 180 prevents the die from rotating about the longitudinal axis of the die shaft so as to misalign the die face.

Figure 19:
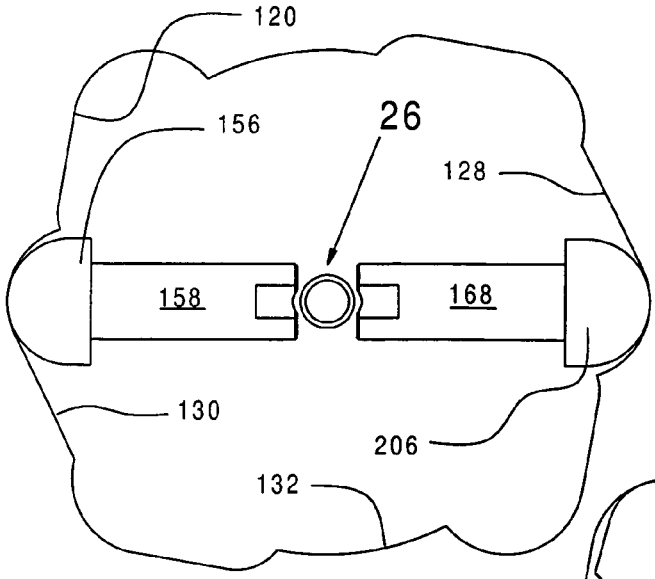
FIG. 19 is a diagrammatic plan view of two opposed crimp-seal dies and the associated cam surface in an uncrimped configuration. In addition to the crimp-seal cam surface for two crimp-seal dies, the associated cam surface also includes all four continuity-cam surfaces. This cam is described for purposes of reference as a continuity-crimp cam, even though it includes two of the four cam surfaces for the crimp-seal dies.
Figure 21:
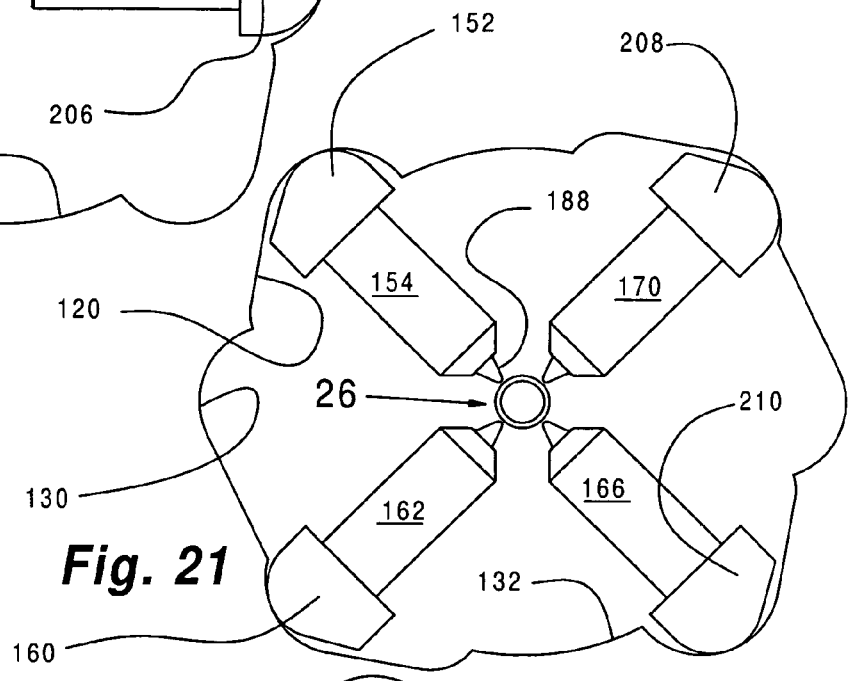
FIG. 21 is a diagrammatic plan view of four opposed continuity-crimp dies similar to FIG. 15 including the associated continuity-crimp cam surface.
Figure 20:
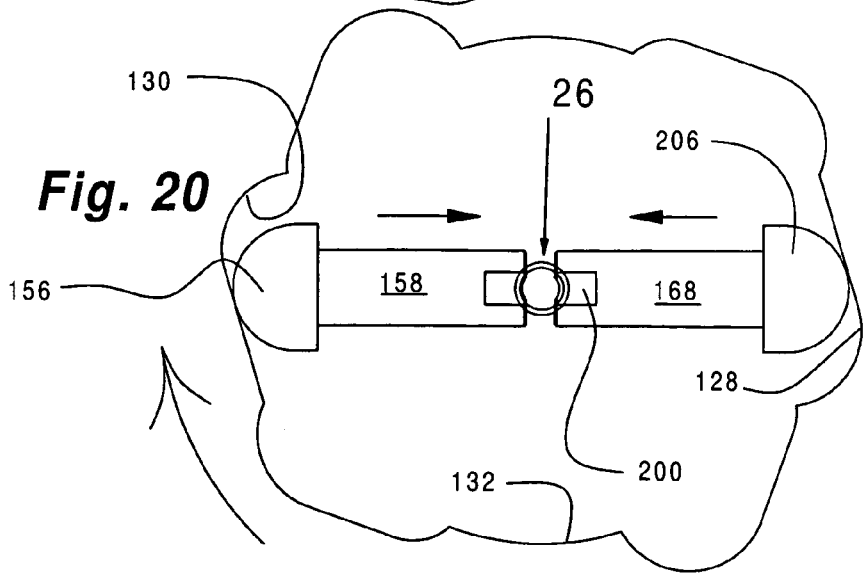
FIG. 20 is a diagrammatic plan view of two opposed crimp-seal dies and the associated continuity-crimp cam surface similar to FIG. 19 wherein the crimp-seal dies have been moved to a crimping position.

With particular reference to FIGS. 19-22, the profile of cam 38 is shown with the associated dies. In FIG. 19 the profile of cam 38 is shown in the fully retracted position that is typical of the start and end of a crimp cycle. In FIG. 20 the profile of cam 38 is shown rotated to the position it typically occupies when the dies are fully extended half way through a crimping cycle. The cam followers 156 and 206 have moved along cam surfaces 130 and 128, respectively, to accomplish the first half of a crimping operation. Only the crimp-seal dies are illustrated in FIGS. 19 and 20. In FIG. 21 the continuity-crimping dies are shown with the profile of cam 38 at the fully retracted position. Rotation of the cam profile to the position shown in FIG. 20 causes the cam followers 152, 160, 210, and 208 to move along the associated cam surfaces to perform a continuity-crimping operation.

With particular reference to FIG. 22, the radially opposed axial ends of crimp-seal die heads 196 and 198 present concave, generally cylindrical die faces 220 and 222, respectively. Flat portions 200 and 202 at the ends of generally cylindrical die shafts 168 and 158, respectively, present radially opposed generally cylindrical die faces 218 and 216, respectively. These four die faces (216, 218, 220, 222), when both cams are in the fully extended configuration, as shown in FIG. 22, define a substantially closed generally cylindrical configuration that forms a contact into a smooth unbroken crimp-seal with the insulation on a wire. The contact is prevented from extruding into the axially extending spaces between the generally cylindrical die faces by providing a close sliding fit between the planar portions (of which 212 is typical) of the die faces of compound crimp-seal die shafts 158 and 168 with the mating planar sides (of which 214 is typical) of die heads 196 and 198.

With particular reference to FIG. 23, in this cross-sectional view of die holder body 36 by itself, radially opposed die bores 50 and 51 share substantially the same longitudinal axis and are shown intersecting axial bore 22. Die bore 80 extends in substantially the same plane as die bores 50 and 51, but substantially normal thereto. Generally rectangular pocket 234 serves the same function as pocket 180, that is it serves to maintain the die face of a die in proper alignment. The die bores (of which 236 is typical) that are axially offset from die bores 50, 51, and 80 also intersect axial bore 22. The cylindrical wall 224 and the frustoconical wall 226 tend to help guide contact-wire assemblies towards axial bore 22. Crimping operations are performed in bore 22. The counter bores 238 and 240 provide convenient mounting locations for sensor related equipment (not shown) and the contact holder.

FIGS. 24 through 27 illustrate the adjustment of the length of the crimping stroke by means of adjusting the length of the crimping arc through which the actuators 40 and 44 drive cams 38 and 42. Stroke limiters 244 and 250 are adjustably mounted to micrometer adjusters 14 and 16, respectively. Actuators 40 and 44 are mounted to actuator drivers 248 and 242, respectively. Actuator drivers 242 and 248 drive the respective actuators through an arc, the length of which is controlled by the width of gaps 246 and 252. Precise adjustment of stroke limiters 244 and 250 defines the widths of gaps 246 and 252, respectively. Widening gap 252, for example, lengthens the stroke of the continuity-crimping dies and the two crimp-seal dies that are activated by cam 38. Widening gap 246 lengthens the stroke of the two crimp-seal dies that are associated with cam 42. Fixed stroke limiters that are not adjustable best serve some applications. The stroke limiters, for example, may take the form of solid stops or limiter switches that deactivate the devices (motors or the like) that are actuating the actuating drivers 242 and 248.

FIGS. 28-31 illustrate typical crimp-seal dies that are actuated by cam 38. FIGS. 32-35 illustrate the continuity-crimping dies that are actuated by cam 38. FIGS. 36-38 illustrate the crimp-seal dies that are actuated by cam 42. The cam followers, of which 156, 152, and 148 are typical, all have generally rectangular plan forms, see for example, FIGS. 29, 33, and 37. The corresponding pockets in the die holder body 36 have generally the same plan forms. This is necessary to maintain the alignment of crimping faces 216, 230, and 222 with the contact. In general, the crimping faces are aligned parallel to the longitudinal axis 102 of the system. The flat faces 202 (FIGS. 29-31) and 260 (FIGS. 36-37) are provided so that there is no undesired or asymmetrical distortion of a contact at the axial end of the crimp-seal dies. The crimping faces 230 of the continuity-crimping dies are preferably configured with two axially aligned indenters, 256 and 258, so as to provide two electrical contacts between a contact 26 and an associated wire core. This insures reliable electrical continuity.

FIG. 39 illustrates by way of a see through schematic the relative positions of the respective dies and contact 26 at the beginning of a crimping cycle. All of the dies shown in FIG. 39 are crimpingly driven by cam 38. Preferably, although not necessarily, cam 38 is activated first and proceeds through at least a part of the crimp forming phase before the other two crimp-seal forming dies are activated by cam 42.

FIG. 40 is a broken cross-sectional view of a die holder body with the end 28 of a contact 26 mounted in a close fit in socket 271 (FIG. 41) of a contact holder in position for a crimping operation. The continuity-crimping dies are shown superimposed over an uncrimped contact to illustrate generally the degree of deformation that these dies cause in the crimping operation. The socket end of the die holder is mounted in bore 22. The other end 269 of the die holder is mounted in the axial bore of a quick detach fitting 268. A mounting ring 266 is held in position in the die holder body by screws, of which 276 is typical. Screw 276 is threadably engaged with the die holder body by means of threaded bore 279. Quick detach fitting 268 is releasably attached to mounting ring 266 by means of radially extending pins 280. Radially opposed notches (not shown) are formed in mounting ring 266 so as to permit pins 280 to pass axially therethrough. A quarter to half a revolution of fitting 268 engages pins 280 with the underside of mounting ring 266 where it is held by the force of compression spring 272. The remote end 275 of the axial bore in fitting 268 is plugged with a vacuum line fitting 274. A compression spring 272 extends in the axial bore of the fitting 268 between the enlarged end 270 of the contact holder and the vacuum line fitting 274. Compression spring 272 serves to hold the contact holder in bore 22, and fitting 268 in engagement with mounting ring 266. The axial bore of quick detach fitting 268 is stepped so that the enlarged end 270 of the contact holder engages the step in the axial bore of fitting 268. The contact holder has an axial bore 264 that extends therethrough. Vacuum line fitting 274 has an axial bore 278 extending therethrough. The shoulder 262 of contact 26 engages and substantially seals the end of socket 271. If vacuum fitting 274 is attached to a vacuum line (not shown) and a vacuum is drawn. The vacuum line is substantially open to atmospheric pressure until a contact is fully. inserted into socket 271. The pressure will drop when a contact 26 is fully seated in socket 271 with shoulder 262 seated against the open end of socket 271. The pressure will rise as soon as the contact is withdrawn. Pressure sensors such as transducers (not shown) or the like may sense these pressure changes. These sensors are configured to generate a first signal when the pressure drops and a second signal when the pressure rises. Preferably, the system is configured so as to allow a crimping operation to be performed only when the removal and insertion of a contact is sensed, unless the system is overridden by the activation of manual reset button 15. This prevents the inadvertent performance of a second crimping action on the same contact-wire assembly. In the embodiment chosen for illustration, a sensor system based on a vacuum has been described. Vacuum based sensor systems had been previously used in contact crimping operations of various kinds, but not in crimping systems of the kind described and claimed herein. Other sensor systems that are not based on breaking or establishing a vacuum may be employed, if desired. Electrical, optical, pneumatic, mechanical, combinations thereof, or the like, sensors may be utilized in both the bench mounted and hand held embodiments of the present invention. The vacuum also serves to hold the contact in the socket 271 in position to be crimped.

The contact holder may be easily and quickly (generally less than one minute by a skilled operator) removed and replaced. Fitting 268 is rotated to align pins 280 with the release slots (not shown) in mounting ring 266 and is axially withdrawn from engagement with the die holder body. Fitting 268 carries the contact holder with it. Fitting 274 and spring 272 are removed from bore 275 and the contact hold is removed. A new contact holder is inserted and the disassembly process is repeated in reverse. The crimp head may thus be quickly reconfigured for a different contact. Where different dies are necessary, a second quick-change crimp head is preferably provided. Changing out a set of dies generally requires more time and skill than is available in a mass production environment. Such a die change out can be accomplished by skilled workers in a few minutes (generally less than 10 minutes).

The quick-change crimp head is axially slidably mounted in a receptacle in the base unit. This head is preferably held there by a special locking mechanism (not shown), so it may be removed and replaced very quickly (generally less than one minute by a skilled operator). Even if some quick release fastener is used to hold the crimp head in place, the total time to change out a crimp head is generally less than two minutes. The use of a common base unit 10 for use with a plurality of quickly changeable and configurable crimp heads provides the capacity for the efficient performance of a wide variety of crimp forming operations in a mass production environment.

Figure 42:
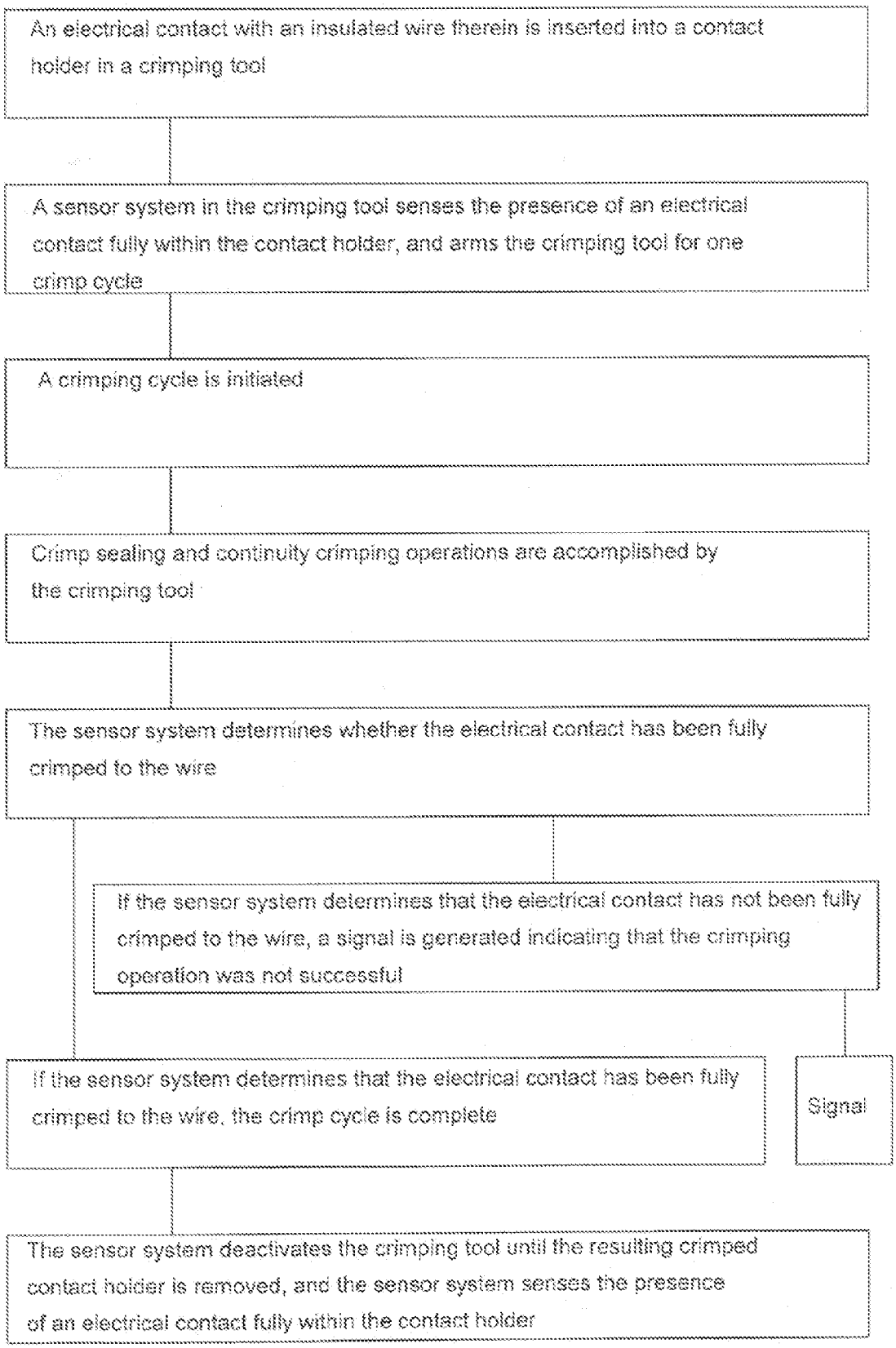
FIG. 42 is a diagrammatic chart that depicts the functioning of the sensors system.

FIG. 42 depicts the operation of the sensor system from the insertion of the electrical contact into a contact holder in a crimping tool through the crimping cycle.

What has been described are preferred embodiments in which modifications and changes may be made without departing from the spirit and scope of the accompanying claims. Many modifications and variations of the present invention are possible in light of the above teachings. It is therefore to be understood that, within the scope of the appended claims, the invention may be practiced otherwise than as specifically described.

What is claimed is:

1. A crimping tool with a quick-change crimp head for sealing and electrically crimping electrical contacts to insulated wires, said crimping tool comprising:

a base unit, said base unit including a receptacle, said receptacle being configured to actuate and removably and replaceably receive said quick-change crimp head;

a crimping die holder body;

a plurality of crimp-seal and continuity-crimping dies mounted for movement in said crimping die holder body between an open configuration and a fully crimped configuration, said crimp-seal dies having arcuate die faces, said arcuate die faces defining a substantially closed generally cylindrical form when said dies are in said fully crimped configuration; and actuators mounted in said base unit, said actuators being adapted to cause said movement;

a sensor system configured to prevent said crimping tool from unintentionally repeating a crimping operation on said electrical contact and to verify continuity-crimp depth of indentation.

2. The crimping tool of claim 1 including a contact holder removably and replaceably mounted in said crimping die holder body.

3. The crimping tool of claim 2 wherein said contact holder is sized so that it is substantially sealed by the presence of a said electrical contact therein, a vacuum line operatively connected to said contact holder, said vacuum line being substantially open to atmospheric pressure when there is no said electrical contact in said contact holder and substantially closed when there is a said electrical contact in said contact holder, and said sensor system includes a pressure sensor member that is configured to generate a first signal when a pressure drop occurs and a second signal when a pressure increase occurs in said vacuum line.

4. The crimping tool of claim 2 including a source of vacuum operatively connected to said contact holder.

5. The crimping tool of claim 2 wherein said sensor system is adapted to sensing the presence of a said electrical contact in said contact holder, said sensor system being configured to allow the performance of a crimping operation by said crimping tool only when the presence of a said electrical contact in said contact holder is sensed, and to prevent the unintentional performance of a second crimping operation.

6. The crimping tool of claim 2 wherein said sensor system is adapted to sensing the presence of a said electrical contact in said contact holder, said sensor system being configured to allow the performance of a crimping operation by said crimping tool only when the presence of a said electrical contact in said contact holder is sensed, and to prevent the unintentional performance of a second crimping operation.

7. The crimping tool of claim 1 wherein said dies are removeably and replaceably mounted in said crimping die holder body.

8. The crimping tool of claim 1 wherein said receptacle and quick-change crimp head have substantially a common longitudinal axis, and said quick-change crimp head is configured to slip axially generally along said common longitudinal axis into and out of said receptacle.

9. The crimping tool of claim 1 wherein said sensor system is adapted to detect whether the depth of an indentation formed by said continuity-crimping dies is at least equal to a predetermined value.

10. The crimping tool of claim 1 where said crimping tool is adapted to being pneumatically actuated.

11. The crimping tool of claim 1 where said crimping tool is adapted to being electrically actuated.

12. The crimping tool of claim 1 where said crimping tool is adapted to being battery powered.

13. A crimping tool with a quick-change crimp head for sealing and electrically crimping electrical contacts to insulated wires, said crimping tool comprising:

a base unit;

a receptacle, said receptacle being located in said base unit, said receptacle being configured to removably and replaceably receive said quick-change crimp head;

a crimping die holder body;

a plurality of crimp-seal and continuity-crimping dies mounted in said crimping die holder body in cam actuateable relationship with crimp-seal and continuity-crimping cams, respectively, said cams being mounted in said quick-change crimp head;

a first actuator for said crimp-seal cam and a second actuator for said continuity-crimping cam, said actuators being mounted in said base unit in actuating association with said cams when said quick-change crimp head is received in said receptacle; and a sensor system configured to prevent said crimping tool from unintentionally repeating a crimping operation on said electrical contact, and to provide an indication of whether said electrical contacts are fully crimped to said insulated wires.

14. The crimping tool of claim 13 wherein said crimp-seal dies include arcuate die faces positioned to form a substantially closed generally cylindrical form around said contact when in the fully crimped configuration.

15. The crimping tool of claim 13 including a quick-change contact holder mounted in said crimping die holder body.

16. A crimping tool with a quick-change crimp head for sealing and electrically crimping electrical contacts to insulated wire, said crimping tool comprising:

a base unit;

a receptacle, said receptacle being located in said base unit, said receptacle and quick-change crimp head having a substantially common longitudinal axis, said quick-change crimp head being adapted to being slidably inserted into and removed from said receptacle generally along said common longitudinal axis;

a crimping die holder body;

a plurality of crimp-seal and continuity-crimping dies mounted in said crimping die holder body in cam actuateable relationship with crimp-seal and continuity-crimping cams, respectively, said cams being mounted in said quick-change crimp head;

a first actuator for said crimp-seal cam and a second actuator for said continuity-crimping cam, said actuators being mounted in said base unit in actuating association with said cams when said quick-change crimp head is received in said receptacle;

a contact holder mounted in said crimping die holder body; and a sensor system configured to prevent said crimping tool from unintentionally repeating a crimping operation on said electrical contact and detecting whether a full continuity-crimping operation has been performed.

17. The crimping tool of claim 16 wherein said contact holder is sized so that it is substantially sealed by the presence of an electrical contact therein, a vacuum line operatively connected to said contact holder, said vacuum line being substantially open to atmospheric pressure when there is no said electrical contact in said contact holder and substantially closed when there is a said electrical contact in said contact holder, and said sensor system includes a pressure sensor that is configured to generate a first signal when a pressure drop occurs and a second signal when a pressure increase occurs in said vacuum line.

18. A crimping tool with a quick-change crimp head for sealing and electrically crimping electrical contacts to insulated aluminum multi-strand core wire, said crimping tool comprising:

a base unit;

a receptacle, said receptacle being located in said base unit, said receptacle and quick-change crimp head having a substantially common longitudinal axis, said quick-change crimp head being adapted to being slidably inserted into and removed from said receptacle generally along said common longitudinal axis;

a crimping die holder body;

a plurality of crimp-seal and continuity-crimping dies mounted in said crimping die holder body in cam actuateable relationship with crimp-seal and continuity-crimping cams, respectively, said cams being mounted in said quick-change crimp head;

a first actuator for said crimp-seal cam and a second actuator for said continuity-crimping cam, said actuators being mounted in said base unit in actuating association with said cams when said quick-change crimp head is received in said receptacle; and a sensor system configured to prevent said crimping tool from unintentionally repeating a crimping operation on said electrical contact and detecting whether a full continuity-crimp has been formed.

* * * * *